US010947715B1

(12) United States Patent
Frey et al.

(10) Patent No.: US 10,947,715 B1
(45) Date of Patent: Mar. 16, 2021

(54) ROOT CUTTER COLLAR WITH QUICK CHANGING SKIDS

(71) Applicants: Stephen R. Frey, Waukesha, WI (US); Richard D. Dresang, Hartford, WI (US); Kevin J. Witt, Jackson, WI (US)

(72) Inventors: Stephen R. Frey, Waukesha, WI (US); Richard D. Dresang, Hartford, WI (US); Kevin J. Witt, Jackson, WI (US)

(73) Assignee: UEMSI/HTV, INC., Jackson, WI (US)

( * ) Notice: Subject to any disclaimer, the term of this patent is extended or adjusted under 35 U.S.C. 154(b) by 0 days.

(21) Appl. No.: 16/800,206

(22) Filed: Feb. 25, 2020

(51) Int. Cl.
*E03F 9/00* (2006.01)
*B08B 9/04* (2006.01)
*B08B 9/043* (2006.01)

(52) U.S. Cl.
CPC ..... *E03F 9/002* (2013.01); *B08B 9/04* (2013.01); *B08B 9/0436* (2013.01)

(58) Field of Classification Search
CPC .... E03F 9/00; E03F 9/002; B08B 9/02; B08B 9/027; B08B 9/04; B08B 9/0436
USPC ..... 15/104.16, 104.18, 104.31
See application file for complete search history.

(56) References Cited

U.S. PATENT DOCUMENTS 4,516,286 A * 5/1985 Crane ..... B08B 9/047 15/104.12
4,766,631 A 8/1988 Crane et al.
5,379,476 A * 1/1995 Salecker ..... B08B 9/0497 15/104.12
7,526,827 B1 5/2009 Bitterman
2003/0190212 A1* 10/2003 Peterkort ..... F16B 41/002 411/119
2006/0108202 A1* 5/2006 Swinderman ..... B65G 45/16 198/499

FOREIGN PATENT DOCUMENTS

WO WO 2018/112411 6/2018

* cited by examiner

*Primary Examiner* — Orlando E Aviles
*Assistant Examiner* — Aaron R McConnell
(74) *Attorney, Agent, or Firm* — Donald J. Ersler

(57) ABSTRACT

A root cutter collar with quick changing skids preferably includes a base tube, a plurality of skid bosses, a plurality of skid retainers, a plurality of threaded fasteners and a plurality of skids. The plurality of skid bosses are attached to an outside perimeter of the base tube. A pair of tapped holes are formed through each skid boss. A location pin extends outward from the skid boss and is located between the pair of tapped holes. Each skid retainer includes two through holes, which are concentric with the two tapped holes in each skid boss. Each skid includes a pair of slotted openings and a pin notch located between the pair of slotted openings. The pin notch is sized to receive the location pin. Threaded fasteners are inserted into the pair of holes in the skid retainer and tightened in the skid boss to retain the skid.

20 Claims, 5 Drawing Sheets

ROOT CUTTER COLLAR WITH QUICK CHANGING SKIDS

BACKGROUND OF THE INVENTION

1. Field of the Invention

The present invention relates generally to sewer inspection and more specifically to a root cutter collar with quick changing skids, which allows different size skids to be changed out without losing nuts, bolts and washers, which retain the skids on a base tube of the root cutter collar.

2. Discussion of the Prior Art

Sewer inspection requires the removal of obstructions and debris inside a sewer pipe. The obstructions frequently include roots from different types of plants and trees. A root cutter tool will cut the root extending through a wall of a sewer pipe. However, the root cutter tool must be centered in the sewer pipe to provide optimal cutting a plant root. A root cutter collar is used to center the root cutter in the sewer pipe. The root cutter collar typically includes a plurality of skids to center the root cutter collar and root cutter tool in a sewer pipe. Sewer pipes have different internal diameters. Thus different size skids are used for different internal diameter pipes. The prior art discloses using bolts, nuts and washers to retain the plurality of skids on the root cutter collar tube. The bolts, nuts and washers may be easily lost and the bolts fully threaded into the nuts each time there is a change of a plurality of skids. U.S. Pat. No. 4,516,286 to Crane discloses a sewer pipeline cleaning apparatus. U.S. Pat. No. 756,827 to Bitterman discloses a drain pipe cleaning apparatus.

Accordingly, there is a clearly felt need in the art for a root cutter collar with quick changing skids, which allows different size skids to be changed out without losing nuts, bolts and washers, which retain the skids on a base tube of a root cutter collar; reduces the number of tools required to change skids to one; and which reduces the amount of time required to change to a different size of skids.

SUMMARY OF THE INVENTION

The present invention provides a root cutter collar with quick changing skids, which allows different size skids to be changed out without losing nuts, bolts and washers, which retain the skids on a root cutter collar tube. The root cutter collar with quick changing skids (root cutter collar) preferably includes a base tube, a plurality of skid bosses, a plurality of skid retainers, a plurality of threaded fasteners and a plurality of skids. The plurality of skid bosses are attached to an outside perimeter of the base tube with welding or any suitable process. A pair of tapped holes are formed through each skid boss. A location pin extends outward from each skid boss and is located between the pair of tapped holes. Each skid retainer includes two through holes which are concentric with the two tapped holes in each skid boss. Each skid includes a pair of fastener slotted openings and a pin notch located between the pair of slotted openings. The pin notch is sized to receive the location pin. Chamfers are formed on the front and back outer sides of the skid to facilitate travel through a sewer pipe. The root cutter collar is preferably assembled in the following manner. A pair of threaded fasteners are preferably inserted through a pair of lock washers and into the pair of holes in the skid retainer. The notch in the skid is inserted on to the location pin and the threaded fasteners are threaded into the pair of the holes in the skid boss. The above process is repeated for the remaining skids, when the plurality of skids are to be changed.

Accordingly, it is an object of the present invention to provide a root cutter collar with quick changing skids, which allows different size skids to be changed without losing nuts, bolts and washers, which retain the skids on a base tube of the root cutter collar.

It is further object of the present invention to provide a root cutter collar, which reduces the number of tools required to change skids to one.

Finally, it is another object of the present invention to provide a root cutter collar, which reduces the amount of time required to change to a different size of skids.

These and additional objects, advantages, features and benefits of the present invention will become apparent from the following specification.

DETAILED DESCRIPTION OF THE PREFERRED EMBODIMENTS

Figure 1:
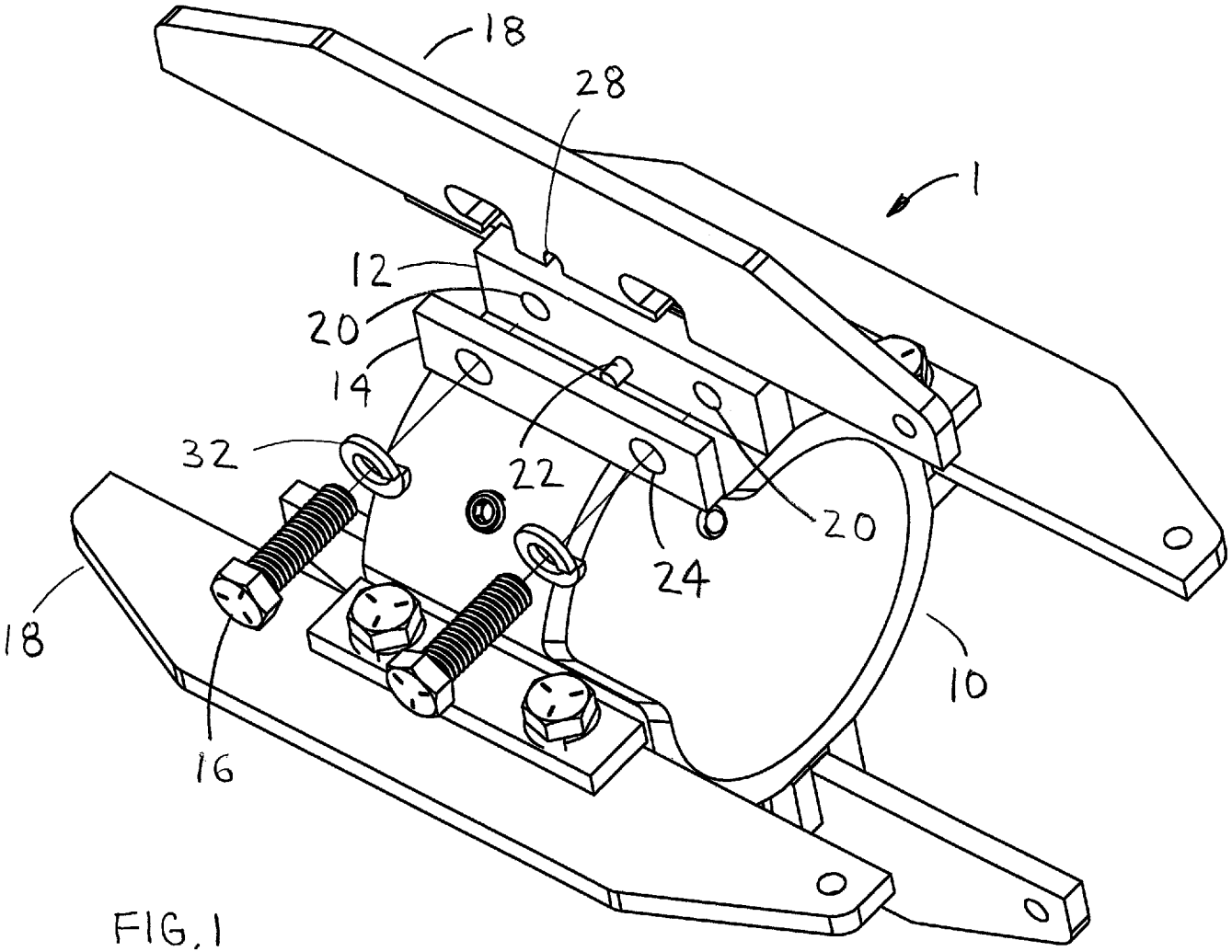
FIG. 1 is a partially exploded perspective view of a root cutter collar and a skid before assembly to a base tube in accordance with the present invention.
Figure 2:
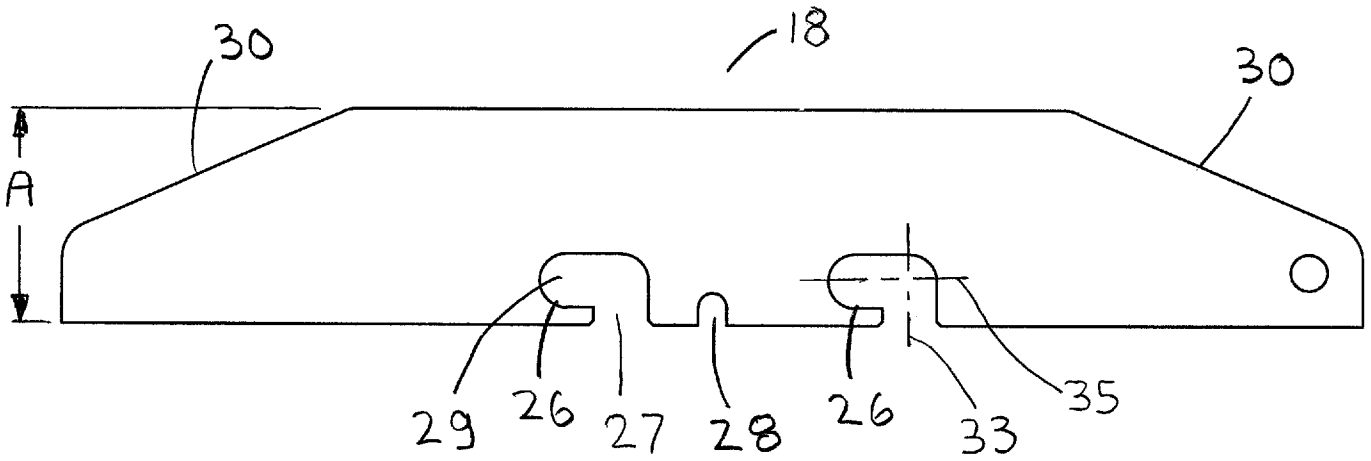
FIG. 2 is a front view of a skid of a root cutter collar in accordance with the present invention.
Figure 3:
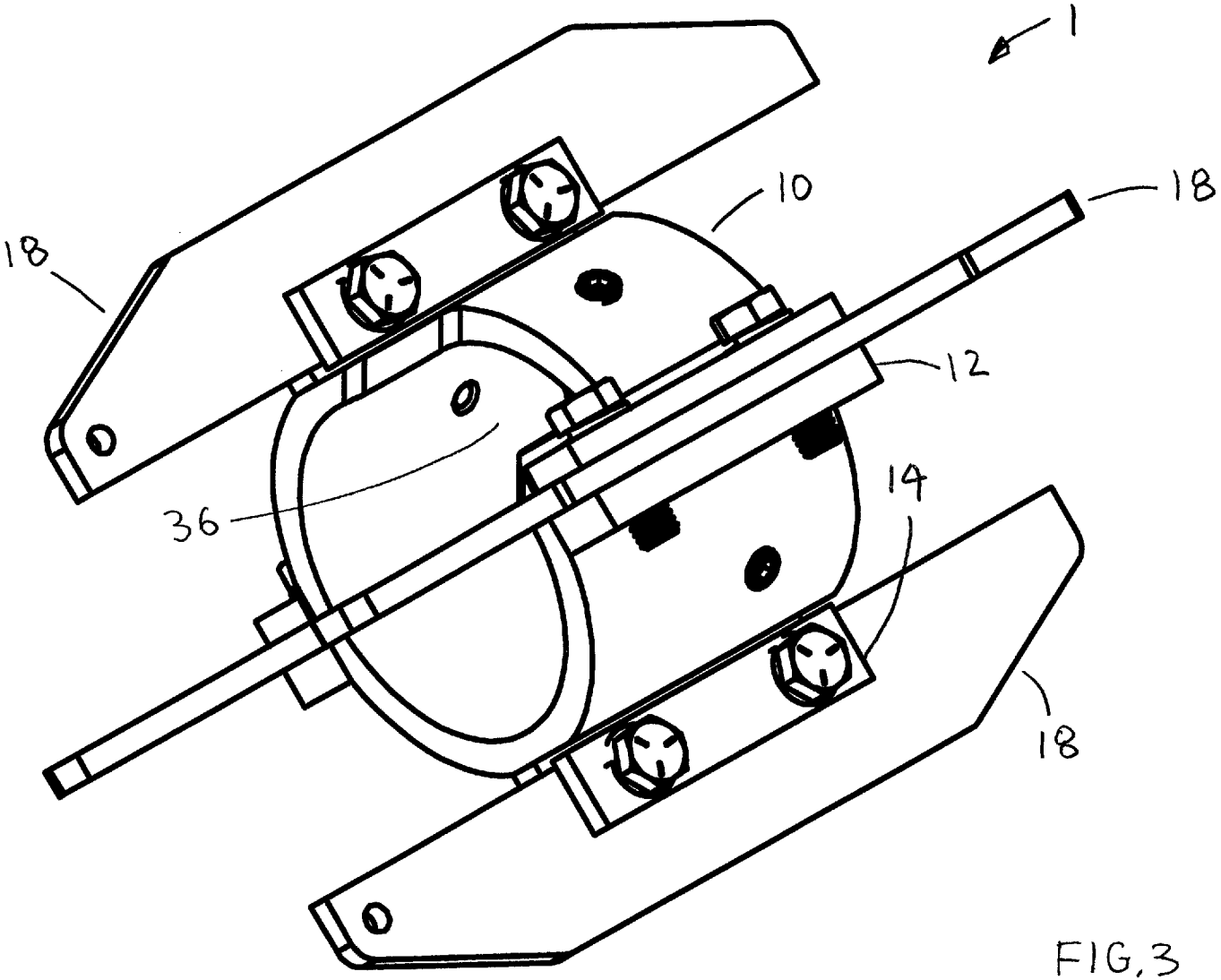
FIG. 3 is a perspective view of a root cutter collar in accordance with the present invention.

With reference now to the drawings, and particularly to FIG. 1, there is shown a root cutter collar 1. With reference to FIGS. 2-3, the root cutter collar 1 preferably includes a base tube 10, a plurality of skid bosses 12, a plurality of skid retainers 14, a plurality of threaded fasteners 16 and a plurality of skids 18. The plurality of skid bosses 12 are attached to an outside perimeter of the base tube 10 preferably with welding or any other suitable process. A pair of tapped holes 20 are formed through each skid boss 12. A location pin 22 preferably extends outward from the skid boss 12 and is located between the pair of tapped holes 20. Each skid retainer 14 includes two through holes 24 which are concentric with the two tapped holes 20 in each skid boss 12. Each skid 18 includes a pair of slotted openings 26 and a pin notch 28 located between the pair of slotted openings 26. Each slotted opening 26 includes an entrance portion 27 and a retention portion 29. The entrance portion 27 communicates with the retention portion 29. An entrance lengthwise axis 33 of the entrance portion 27 is perpendicular to a lengthwise retention axis 35 of the entrance portion 29. The pin notch 28 is sized to receive the location pin 22. Chamfers 30 are formed on the front and back outer sides of the skid 18 to facilitate travel through a sewer pipe. A dimension "A" of the skid 18 is increased to accommodate pipes with a larger internal diameter.

Figure 4:
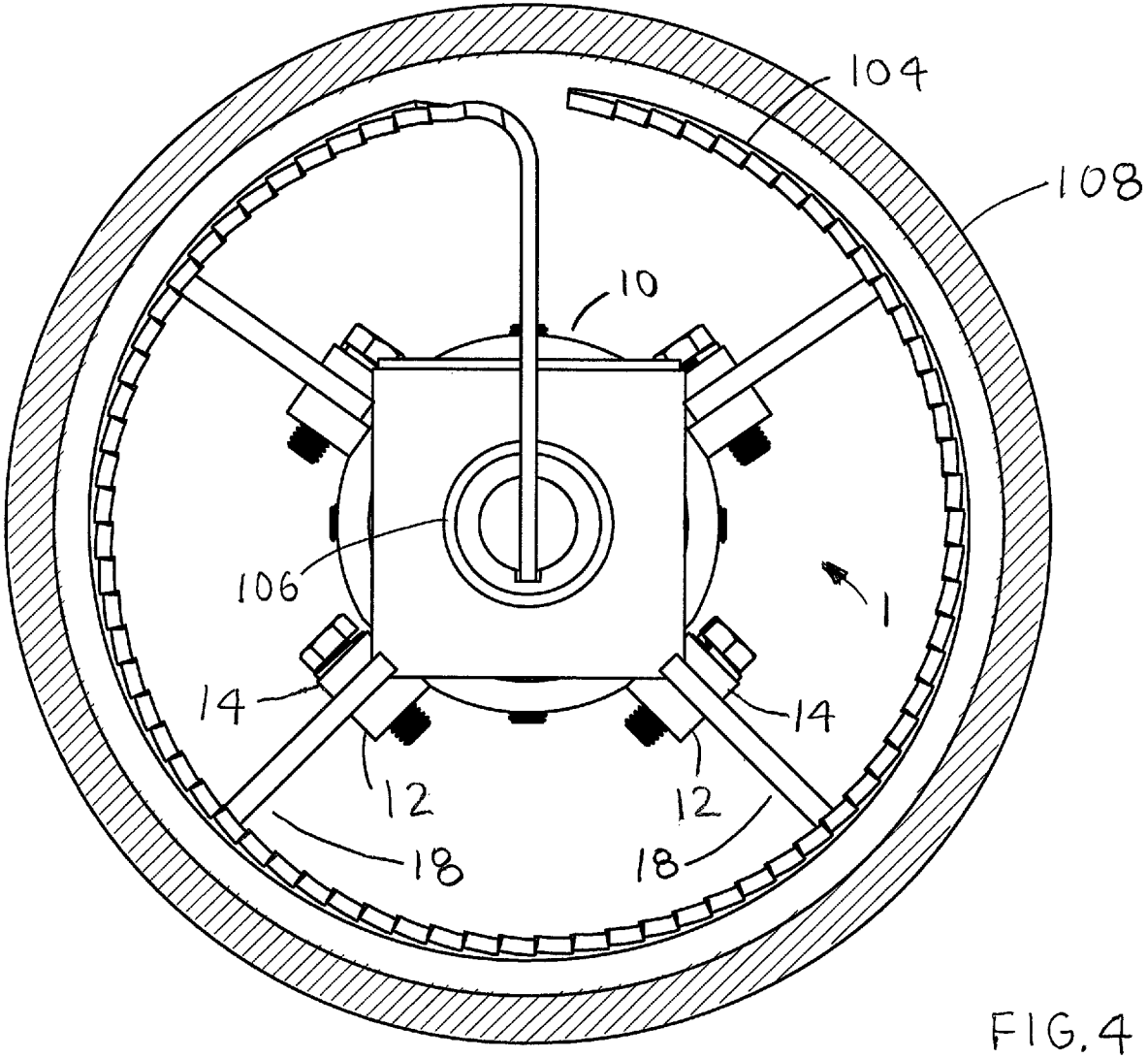
FIG. 4 is an end view of a root cutter collar secured to a root cutter and retained in a sewer pipe in accordance with the present invention.
Figure 5:
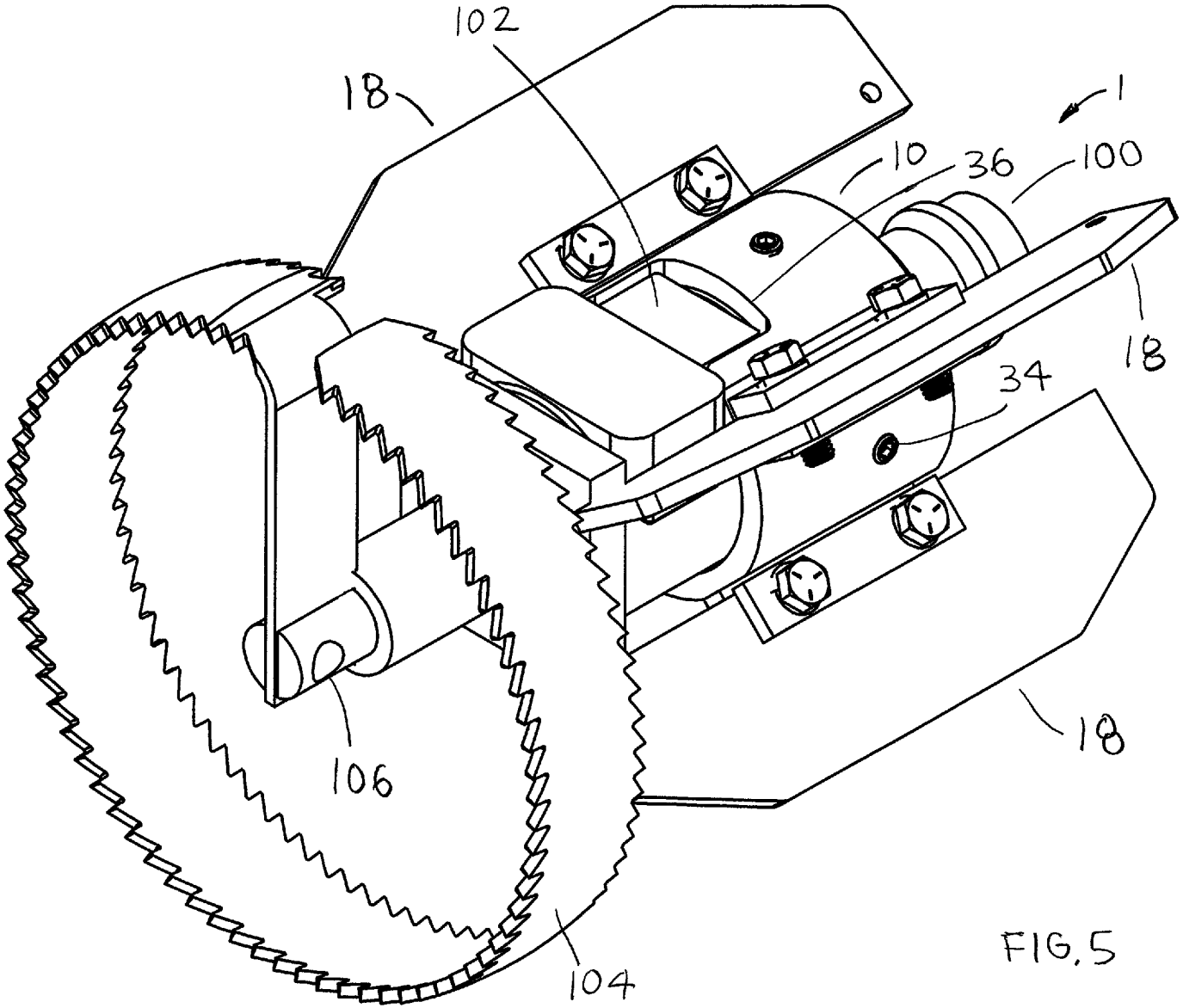
FIG. 5 is a perspective view of a root cutter collar secured to a root cutter and a cutting blade retained in an end of the root cutter in accordance with the present invention.

The root cutter collar 1 is preferably assembled in the following manner. The pair of threaded fasteners 16 are preferably inserted through a pair of lock washers 32 and into the pair of holes 24 in the skid retainer 14. The location pin 22 is inserted into the notch 28 in the skid 18 and the threaded fasteners 16 are threaded into the pair of the holes 20 in the skid boss 12. This process is repeated for the remaining skids 18, when the plurality of skids 18 are to be changed. Changing the skids 18 to another size requires loosening the fasteners enough to allow the skids 18 to be pulled against the skid retainers 14 and slid horizontally and pulled vertically upward to remove the skids 18 from the pair of threaded fasteners 16. With reference to FIGS. 4-5, a root cutter 100 is inserted into the base tube 10. The root cutter collar 1 is preferably secured to the root cutter with at least one set screw 34. The at least one set screw 34 prevents axially movement of the root cutter 100 relative to the root cutter collar 1. A receiver notch 36 is formed in an end of the base tube 10 to receive a cutter boss 102 on some models of root cutters 100. A cutting blade 104 is retained in a blade retaining shaft 106 of the root cutter 100 and the assembly of the root cutter collar 1, the root cutter 100 and the cutting blade 104 are retained in a sewer pipe 108.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

We claim:

1. A root cutter collar comprising:

a base tube having an inner base perimeter which sized to receive a root cutter;

a plurality of skid bosses are attached to an outer perimeter of said base tube, at least one threaded hole is formed in each one of said plurality of skid bosses;

a plurality of skid retainers each one having at least one through hole formed therethrough, said plurality of skid retainers are indirectly attached to said base tube;

a plurality of threaded fasteners are slidably inserted through said at least one through hole; and a plurality of skids each having at least one slotted opening which is shaped to receive said at least one threaded fastener, wherein each of said at least one slotted openings has an entrance portion formed in a perimeter of each one of said plurality of skids, wherein one of said plurality of skids is retained between one of said plurality of skid bosses and one of said plurality of skid retainers with one of said plurality of threaded fasteners.

2. The root cutter collar of claim 1 wherein: said entrance portion communicates with a retention portion, an entrance lengthwise axis of said entrance portion is perpendicular to a retention lengthwise axis of said entrance portion.

3. The root cutter collar of claim 1 wherein:

at least one threaded tap is formed through said base tube to receive a threaded fastener to axially retain the root cutter in said base tube.

4. The root cutter collar of claim 1 wherein:

a receiver notch is formed in an end of said base tube to receive a cutter boss of the root cutter.

5. The root cutter collar of claim 1 wherein:

said plurality of threaded fasteners are a plurality of threaded bolts.

6. The root cutter collar of claim 5, further comprising:

a plurality of lock washers are retained on said plurality of threaded fasteners.

7. A root cutter collar comprising:

a base tube having an inner base perimeter which sized to receive a root cutter;

a plurality of skid bosses are attached to an outer perimeter of said base tube, at least two threaded holes are formed in each one of said plurality of skid bosses, a location pin extends outward from each one of said plurality of skid bosses;

a plurality of skid retainers each one having at least two through holes formed therethrough, said plurality of skid retainers are indirectly attached to said base tube;

a plurality of threaded fasteners are slidably inserted through said at least two through holes; and a plurality of skids each having at least two slotted openings which are shaped to receive said at least two threaded fasteners, wherein each of said at least two slotted openings has an entrance portion formed in a perimeter of each one of said plurality of skids, a pin notch is formed adjacent to said at least two slotted openings to receive said location pin, wherein one of said plurality of skids is retained between one of said plurality of skid bosses and one of said plurality of skid retainers with two of said plurality of threaded fasteners.

8. The root cutter collar of claim 7 wherein: said entrance portion communicates with a retention portion, an entrance lengthwise axis of said entrance portion is perpendicular to a retention lengthwise axis of said entrance portion.

9. The root cutter collar of claim 7 wherein:

at least one threaded tap is formed through said base tube to receive a threaded fastener to axially retain the root cutter in said base tube.

10. The root cutter collar of claim 7 wherein:

a receiver notch is formed in an end of said base tube to receive a cutter boss of the root cutter.

11. The root cutter collar of claim 7 wherein:

said plurality of threaded fasteners are a plurality of threaded bolts.

12. The root cutter collar of claim 11, further comprising:

a plurality of lock washers are retained on said plurality of threaded fasteners.

13. A root cutter collar comprising:

a base tube having an inner base perimeter which sized to receive a root cutter;

a plurality of skid bosses are attached to an outer perimeter of said base tube, two threaded holes are formed in each one of said plurality of skid bosses;

a plurality of skid retainers each one having two through holes formed therethrough, said plurality of skid retainers are indirectly attached to said base tube;

a plurality of threaded fasteners are slidably inserted through said at least two through holes; and a plurality of skids each having two fastener slotted openings which are shaped to receive said at least one threaded fastener, wherein each of said fastener slotted openings has an entrance portion formed in a perimeter of each one of said plurality of skids, wherein one of said plurality of skids is retained between one of said plurality of skid bosses and one of said plurality of skid retainers with two of said plurality of threaded fasteners.

14. The root cutter collar of claim 13 wherein: said entrance portion communicates with a retention portion, an entrance lengthwise axis of said entrance portion is perpendicular to a retention lengthwise axis of said entrance portion.

15. The root cutter collar of claim 13 wherein:

at least one threaded tap is formed through said base tube to receive a threaded fastener to axially retain the root cutter in said base tube.

16. The root cutter collar of claim 13 wherein:

a receiver notch is formed in an end of said base tube to receive a cutter boss of the root cutter.

17. The root cutter collar of claim 7 wherein:

said plurality of threaded fasteners are a plurality of threaded bolts.

18. The root cutter collar of claim 17, further comprising:

a plurality of lock washers are retained on said plurality of threaded fasteners.

19. The root cutter collar of claim 1 wherein: said plurality of skid bosses and said plurality of skid retainers retain a middle portion of said plurality of skids.

20. The root cutter collar of claim 7 wherein: said plurality of skid bosses and said plurality of skid retainers retain a middle portion of said plurality of skids.

* * * * *